US005850237A

United States Patent [19]

Slade

[11] Patent Number: 5,850,237

[45] Date of Patent: Dec. 15, 1998

[54] METHOD AND DEVICE FOR SELECTIVE RECORDING HEAD MAINTENANCE FOR AN INK RECORDING APPARATUS

[75] Inventor: Michael L. Slade, Rochester, N.Y.

[73] Assignee: Xerox Corporation, Stamford, Conn.

[21] Appl. No.: 670,911

[22] Filed: Jun. 26, 1996

[51] Int. Cl.[6] ..... B41J 2/165; B41J 29/38

[52] U.S. Cl. ..... 347/23; 347/14

[58] Field of Search ..... 347/14, 17, 19, 347/23, 35, 60; 342/23, 35, 19, 14

[56] References Cited

U.S. PATENT DOCUMENTS

| | | | |
|---|---|---|---|
| Re. 32,572 | 1/1988 | Hawkins et al. . | |
| 3,925,788 | 12/1975 | Kashio . | |
| 3,925,789 | 12/1975 | Kashio . | |
| 4,558,332 | 12/1985 | Takahashi | 347/14 |
| 4,571,599 | 2/1986 | Rezanka . | |
| 4,638,337 | 1/1987 | Torpey et al. . | |
| 4,746,938 | 5/1988 | Yamamori et al. . | |
| 4,849,774 | 7/1989 | Endo et al. . | |
| 4,853,717 | 8/1989 | Harmon et al. . | |
| 4,855,764 | 8/1989 | Humbs et al. . | |
| 4,970,527 | 11/1990 | Gatten . | |
| 5,122,812 | 6/1992 | Hess et al. . | |
| 5,170,186 | 12/1992 | Shimamura et al. . | |
| 5,210,550 | 5/1993 | Fisher et al. . | |
| 5,248,999 | 9/1993 | Mochizuki et al. . | |
| 5,250,962 | 10/1993 | Fisher et al. . | |
| 5,266,975 | 11/1993 | Mochizuki et al. . | |
| 5,300,968 | 4/1994 | Hawkins . | |
| 5,371,530 | 12/1994 | Hawkins et al. . | |
| 5,386,222 | 1/1995 | Iwata . | |
| 5,404,158 | 4/1995 | Carlotta et al. . | |
| 5,404,229 | 4/1995 | Ono et al. . | |
| 5,406,317 | 4/1995 | Shimmaura et al. . | |
| 5,495,271 | 2/1996 | Koitabashi et al. | 347/23 |
| 5,565,898 | 10/1996 | Sakuma | 347/23 |
| 5,583,547 | 12/1996 | Gast et al. | 347/22 |

FOREIGN PATENT DOCUMENTS

| | | | |
|---|---|---|---|
| 63-252748 | 10/1988 | Japan | 347/23 |
| 1-127362 | 5/1989 | Japan | 347/23 |
| 3-244549 | 10/1991 | Japan | 347/23 |

*Primary Examiner*—Benjamin R. Fuller
*Assistant Examiner*—Thien Tran
*Attorney, Agent, or Firm*—Oliff & Berridge, PLC

[57] ABSTRACT

An apparatus and method are described for maintaining the proper operation of an ink recorder having an ink recording head which prints an image on a recording medium by selectively depositing ink drops from a plurality of ink ejectors in response to image data. The ink recorder supports a plurality of performance modes and may be a color image recorder having a plurality of color inks and a plurality of ink ejectors for each color ink. A time period during printing is determined and the number of print drop commands received by each of the plurality of ink ejectors is counted during the time period. A target value for the number of print drop commands received by each ejector is set based on a pre-determined one of the plurality of performance modes, the image data, and a characteristic of each color ink in the case of a color ink recorder. If, during the time period determined, all of the ejectors receive the appropriate target number of print commands, then a purge ink procedure is not executed and printing is not interrupted. The print quality, overall printing speed, and ink waste are optimized by utilizing all of the factors cited in setting the target values for the number of print commands to be received by each ink ejector in order to avoid unneeded purge ink procedures.

16 Claims, 7 Drawing Sheets

METHOD AND DEVICE FOR SELECTIVE RECORDING HEAD MAINTENANCE FOR AN INK RECORDING APPARATUS

BACKGROUND OF THE INVENTION

1. Field of the Invention

This invention relates generally to maintaining the operation of an ink recording printhead in an ink recording apparatus for recording an image on a receiving medium. More particularly, this invention relates to a method and device for monitoring the ejection of drops from the ink ejectors of the printhead to enable selective maintenance of the image quality produced by the printhead while achieving high recording speed consistent with pre-selected performance modes of the recording apparatus.

2. Description of Related Art

Ink recorders of the type frequently referred to as ink jet printers, acoustic ink printers, or liquid ink printers, have at least one printhead from which droplets of ink are directed to a recording medium. Common methods of directing the ink droplets include continuous jetting under pressure followed by electrostatic or magnetic control of the flight of the droplets; drop ejection on-demand by pressure pulse from a piezoelectric transducer, a thermally expanding liquid or solid member, focused acoustic energy, or an induced liquid-vapor phase transition; or, on-demand extraction of the ink from a nozzle or pool by electrostatic, magnetic or wetting forces. In the most prevalent drop-on-demand ink jet recorders, the ink may be contained in a plurality of channels within the printhead where pressure pulses which push ink out of the channels or extraction force pulses which pull ink out of the channels are used to selectively direct ink to the image receiving medium. In order to define small droplets of liquid so that high quality printing of an image may be done, the channels and, especially, the ink emitting ending orifices or nozzles of the channels, may be narrow and have a cross-sectional area on the order of the cross-sectional area of the drops to be emitted.

In a thermal ink jet printer, pressure pulses are generated by rapidly heating ink in a small channel or chamber so that a component of the ink expansively vaporizes creating a pressure impulse that ejects ink from an orifice in liquid communication with the channel or chamber. The ink heating pulses are usually produced by resistors located on an inner surface of the ink channels or chambers which are pulsed with sufficient electric voltage to vaporize an ink component in a portion of the ink adjacent the resistors, typically, water. Thermal ink jet printheads usually have a plurality of ink emitters and a corresponding plurality of ink heating resistors that are individually addressable by voltage pulses to heat and vaporize ink. Thus the emission of ink drops from the plurality of emitters can be electronically controlled by the timing of voltage pulses applied to the resistor heaters corresponding to each of the plurality of emitters. Following a short time duration voltage pulse to a heater, ink adjacent the heater vaporizes explosively, pushing ink out of an orifice that is in close fluid communication with the channel or chamber where the vapor bubble has been generated. The vapor in the bubble quickly cools and transitions back to a liquid state. This transition causes the bubble to collapse to create partial vacuum pressure that pulls ink away from the emitting orifice. This push-pull sequence causes a portion of the liquid at the orifice to separate as a droplet and continue moving in a direction away from the orifice and towards the recording medium. Capillary action of the ink in the narrow channels and constricted orifice region draws ink from an ink supply reservoir thereby readying the thermal ink jet drop emitter for the next electronic command to print a drop. Operation of a thermal ink jet printer is described in, for example, U.S. Pat. No. 4,849,774.

One particular form of thermal ink jet printer is described in U.S. Pat. No. 4,638,337. That printer is of the carriage type and has a plurality of printheads, each with its own ink supply reservoir, mounted on a reciprocating carriage. Such a plurality of printheads may be used for color printing, each printhead having a different color of ink. The nozzles in each printhead are aligned substantially perpendicularly to the line of movement of the carriage and a swath of information is printed on a stationary recording medium as the carriage is moved in one direction. The recording medium is then stepped, perpendicularly to the line of carriage movement, by a distance equal to the width of the printed swath. The carriage is then moved in the reverse direction to print another swath of information.

It has been recognized that there is a need to maintain the ink ejecting nozzles and channels of an ink jet printhead, for example, by capping the printhead when the printer is idle for extended periods of time. Capping the printhead is intended to prevent the ink in the printhead from drying out, which could prevent ink from being properly ejected from a nozzle. There is also a need to prime a printhead before use to ensure that the printhead channels are completely filled with ink and contain no contaminants or air bubbles, and to also periodically eject ink from the nozzles of an uncapped printhead to maintain proper ink characteristics and functioning of the drop ejection process. The periodic ejection of ink from the nozzles of an uncapped printhead, also known as ink purging, is done to counteract the effects of ink component evaporation at the ink-air surface located at the ink emitting orifice. Especially in the case of thermal ink jet inks, some ink component is necessarily vaporizable and, therefore, somewhat volatile and subject to evaporation. Purging ink periodically from a nozzle subject to evaporation serves to eliminate ink whose properties have changed due to loss of a volatile component, thereby eliminating a potential source of poor ejection performance. Maintenance stations designed to maintain ink jet printheads of various types are described in, for example, U.S. Pat. Nos. 4,855,764; 4,853,717; and 4,746,938.

Various methods and apparatus for maintaining the operation of ink recording heads are described in the following disclosures. In U.S. Pat. Nos. 3,925,788 and 3,925,789 to Kashio, an ink jet maintenance apparatus includes a timer for timing the duration of a non-printing interval so that a preliminary ejection of ink (ink purging) is effected before resuming printing if the non-printing time interval exceeds a predetermined value.

U.S. Pat. No. 4,970,527 to Gatten describes an ink jet printing system having a timer which measures the elapsed time since the printhead has last printed. If a preset time value is exceeded since the last printing, the printhead is directed to purge a number of drops from each jet onto an ink receiving blotter, or onto the image receiving medium itself if no purge ink receiver is present.

U.S. Pat. No. 5,170,186 to Shimamura et al. discloses an ink jet recording apparatus with a printhead maintenance function which includes a purge ink receiver and an absorption unit for absorbing ink from the purge ink receiver. Purge ink ejection is performed after uncapping the printhead and at time intervals during printing in order to maintain ink ejector performance. The amount of purged ink is estimated by a controller and the ink absorption unit activated to remove purge ink from the purge ink receiver when the estimated value of purge ink exceeds a predetermined limit.

In U.S. Pat. No. 5,210,550 to Fisher et al., a maintenance station for an ink jet printer is described. The maintenance station is located adjacent a printhead maintenance position periodically occupied by the printhead and is positionable towards and away from the printhead. The maintenance station performs a first function of providing a humid environment for the printhead orifices, and a second function of priming, which includes drawing ink from an ink supply and filling the printhead channels.

U.S. Pat. Nos. 5,248,999 and 5,266,975 to Mochizuki and Mozchizuki et al., describe an ink jet type recording device having an ink purging feature. A memory circuit is provided for storing data representing the quantity of waste ink sucked out by a suction pump. A control circuit is provided for nullifying an ink purging instruction when the sum of quantities of waste ink exceeds a predetermined value, thereby preventing excessive ink purging.

U.S. Pat. No. 5,250,962 to Fisher et al. describes a movable ink jet priming station. The movable priming station is capable of priming a portion of an extended array of nozzles of an ink jet printhead at one time by applying a vacuum to at least one nozzle located on the portion of the extended array.

U.S. Pat. No. 5,386,222 to Iwata describes an ink jet maintenance station including a purge ink receiving member and a secondary ink conveying device that conveys waste ink from the purge ink receiver to a waste storage receptacle. A controller positions the recording head opposite the purge ink receiver when purging is effected and moves the recording head away from this position when the ink conveying device is activated. Ink purging is effected periodically during printing if a preset time interval is exceeded.

U.S. Pat. No. 5,404,158 to Carlotta et al. describes an ink jet printer maintenance system. When the printer is in a non-printing mode, a printhead mounted on a translatable carriage is translated to the maintenance station located outside and to one side of the printing zone. Various maintenance functions, such as capping, wiping, and purging, are provided depending upon the location of the carriage mounted printhead within the maintenance station.

U.S. Pat. No. 5,404,229 to Ono et al. describes a first ink jet facsimile recording system which includes a printhead maintenance subsystem, the status of which can be communicated to a second facsimile system which is in communication with the first ink jet facsimile system. The maintenance subsystem of the first ink jet facsimile recorder includes an apparatus for carrying out ink purging at preset time intervals during the reception of facsimile transmissions from the second facsimile system.

U.S. Pat. No. 5,406,317 to Shimamura et al., discloses an ink jet recording apparatus with a printhead maintenance subsystem including both capping and ink purging functions. The ink purging function is carried out at predetermined time intervals during a printing operation. The printhead is also returned to the capping position during the printing operation if other timing conditions are met. Printhead capping time is excluded from the ink purging time interval calculation.

U.S. patent application Ser. No. 08/626,300 to Donahue et al., entitled "Selective Nozzle Maintenance for a Liquid Ink Printhead", and assigned to the assignee of the present application, describes an ink jet printhead maintenance apparatus and method for maintaining a printhead with a plurality of liquid ejectors. In particular, the disclosed maintenance system uses both image data as well as a predetermined time interval to determine the number of purge ink drops to be ejected from each nozzle of the printhead during a purging operation.

The disclosures cited above demonstrate that the need, devices and methods for periodically ejecting purge ink droplets from an ink recording printhead in order to maintain acceptable performance are recognized. However, periodic ink purging for maintenance purposes has the drawbacks of interrupting printing in certain circumstances, using valuable ink for non-printing purposes, and requiring provision for removal and storage of the purged ink. Therefore an ink recording apparatus is needed that optimally balances the advantages to ink recording head maintenance of ink periodic purging with other important recorder performance attributes such as overall printing speed, minimum waste of printing ink, and minimum space and mechanism requirements to manage purged ink.

The appropriate frequency of ink purging is related to the properties of the ink compositions being used, many recording head parameters, environmental factors such as temperature and humidity, and the desired print quality. For a given set of ink, printhead and environmental parameter values, the frequency of ink purging can be decreased at the expense of more variation in drop ejection performance attributes such as drop velocity, direction and volume. Such variations, in turn, cause print quality imperfections arising from misplaced and incorrectly sized ink spots.

An ink recorder may operate in a variety of performance modes that offer the user different image quality outcomes at different overall printing speeds. For example it is common for ink jet printers to offer a draft mode in addition to a normal quality mode. In the draft mode the printhead may not print every image dot or may print them at a drop repetition frequency above the frequency used for normal mode printing. A lower quality of printing but a significantly higher overall throughput speed is achieved.

In color ink recorders, a plurality of inks are used, for example, black, cyan, magenta, and yellow inks. Each of these inks may have a different response to the frequency of ink purging. And, also, the overall affect on the quality of the color image may be different for different amounts of misplaced and incorrectly sized ink spots of the different individual ink colors.

SUMMARY OF THE INVENTION

One object of the present invention is to overcome the deficiencies of the prior art printing devices. In the present invention, the variation in print quality requirements of different ink recorder performance modes, the different effects of each color ink separation on the overall print quality of a multi-color image, and the different ink compositions in a multi-color ink recorder are factors in optimizing the implementation of ink purging for maintaining the ink recording head of an ink recorder.

In accordance with one aspect of the present invention, there is provided an ink recording apparatus for recording an image on a receiving medium in a plurality of performance modes. The recording apparatus includes an ink recording head having a plurality of ink ejectors for ejecting ink drops in response to the image data and a maintenance subsystem including a purge ink receiver, periodically co-operable with the ink recording head, and a maintenance controller for directing the ink recording head maintenance procedures. The maintenance controller is in communication with the ink recording head and a mechanism for positioning the recording head and purge ink receiver opposite each other, and directs the ejection of purge ink drops into the purge ink receiver as a function of the image data and a pre-selected one of the plurality of performance modes.

In accordance with another aspect of the invention, there is provided an ink recording apparatus for recording a color image on a receiving medium. The recording apparatus includes an ink recording head having a plurality of color inks and a plurality of ink ejectors for each color ink which eject ink drops in response to color image data; and, a maintenance subsystem including a purge ink receiver, periodically co-operable with the ink recording head, and a maintenance controller for directing the ink recording head maintenance procedures. The maintenance controller, which is in communication with the ink recording head and a mechanism for positioning the recording head and purge ink receiver opposite each other, directs the ejection of purge ink drops into the purge ink receiver as a function of the color image data and at least one property of each of the plurality of color inks.

In a further aspect of the invention, the ink recording apparatus for recording a color image on a receiving medium has a plurality of performance modes. The maintenance controller directs the ejection of purge ink drops into the purge ink receiver as a function of the color image data, at least one property of each of the plurality of color inks, and a pre-selected one of the plurality of performance modes.

In yet another aspect of the invention there is provided a method of maintaining the proper operation of an ink recording apparatus recording an image in a plurality of performance modes on a receiving medium by depositing ink drops from an ink recording head in response to image data. The method includes determining the necessity of performing a purge ink procedure as a function of the image data and a pre-selected one of the plurality of performance modes; interrupting printing, positioning the recording head and the purge ink receiver opposite each other, selectively performing a purge ink procedure, if necessary; and generating a maintenance reset signal if ink purging is not necessary.

These and other aspects of the invention will be described in or apparent from the following detailed description of preferred embodiments.

BRIEF DESCRIPTION OF THE DRAWINGS

Preferred embodiments of the invention will be described with reference to the attached drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF PREFERRED EMBODIMENTS

Figure 1:
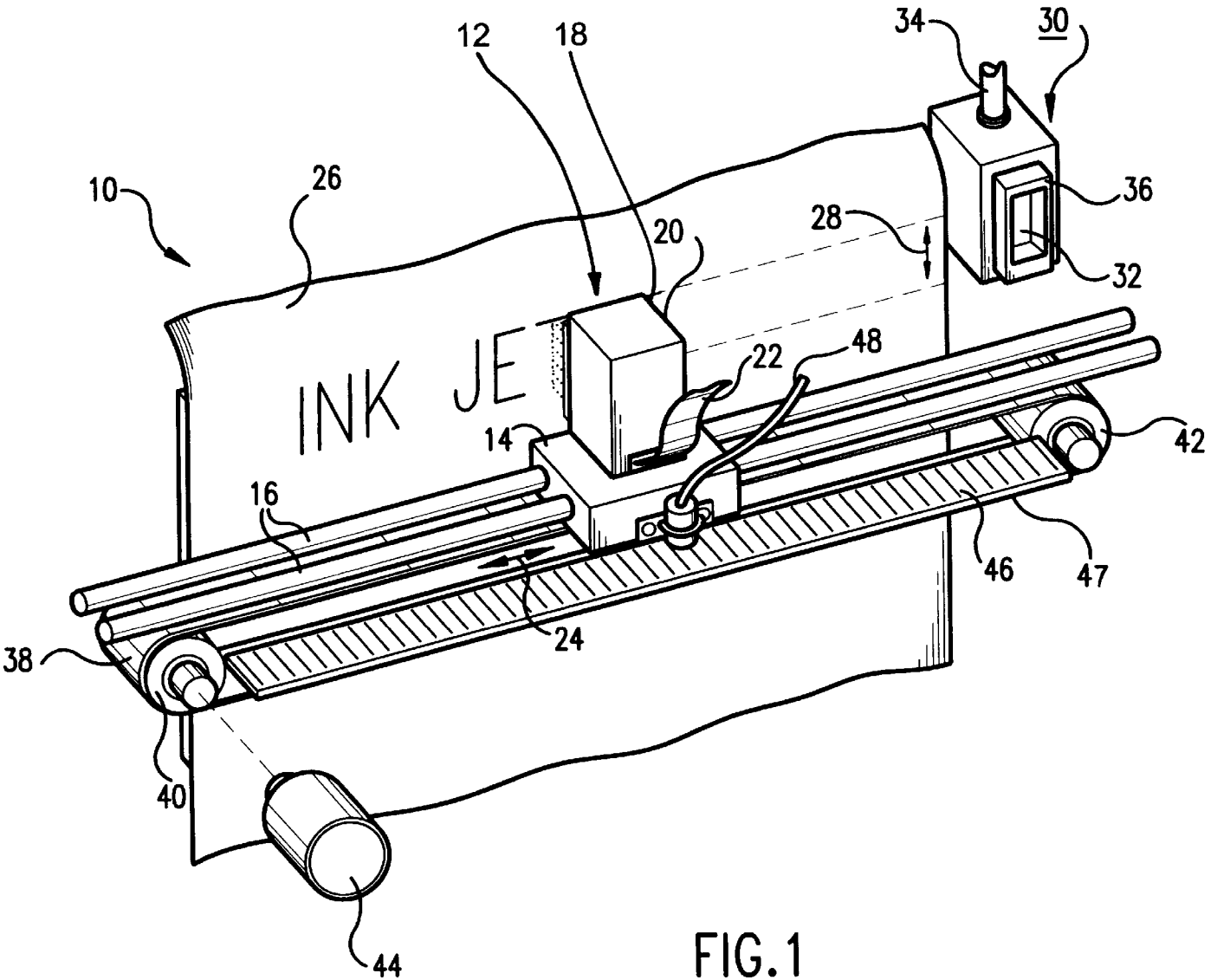
FIG. 1 illustrates a partial schematic perspective view of an ink recording apparatus of the ink jet type including a maintenance station and carriage driven thermal ink jet printhead according to the present invention.

FIG. 1 illustrates a partial schematic perspective view of an ink recording apparatus 10, e.g., a printer, having a thermal ink jet printhead cartridge 12 mounted on a carriage 14 supported by carriage rails 16. The printhead cartridge 12 includes a housing 18 containing ink for supply to a thermal ink jet device 20 which expels drops of ink under control of electrical signals received from a controller or central processing unit (not shown) of the printer 10 through an electrical cable 22. The thermal ink jet device 20 contains a plurality of ink channels (not shown) which carry ink from the housing 18 to respective ink ejecting orifices or nozzles (also not shown). When printing, the carriage 14 reciprocates or scans back and forth along the carriage rails 16 in the direction of an arrow 24. As the printhead cartridge 12 reciprocates back and forth across a recording medium 26, such as a sheet of paper or a transparency, drops of ink are expelled from selected ones of the printhead nozzles towards the sheet of paper 26 to form an image comprising ink dot patterns within a plurality of fine scan lines. The ink ejecting orifices or nozzles are typically arranged in an array extended perpendicular to the scanning direction 24. Each nozzle writes a portion of the image on one of the plurality of scan lines, as it traverses the recording medium. During each pass of the carriage 14, the recording medium 26 is held in a stationary position. At the end of each pass, however, the recording medium is stepped in the direction of an arrow 28. For a more detailed explanation of the printhead and printing, reference is made to U.S. Pat. No. 4,571,599 and U.S. Pat. No. Reissue 32,572, which are incorporated herein by reference.

At one side of the printer 10, outside a printing zone, which encompasses the width of the recording medium 26, is a maintenance station 30, a portion thereof which is illustrated. At the end of a printing operation, or at other times when necessary, the printhead carriage 14 is moved to a maintenance position confronting the maintenance station 30 which includes a chamber 32 to which a suction device is connected and through which a vacuum is applied through a vacuum line 34. The chamber 32 includes an opening having attached thereto a maintenance/priming element 36 which contacts the opposing face of the printhead cartridge 12 and forms a seal around the nozzles 64 of the thermal ink jet device 20 when the carriage is located at the maintenance station position. During a priming operation, a vacuum pump (not shown) applies vacuum to the vacuum line 34 through a waste tank (not shown) for removing ink or debris to ensure proper operation of the ink jet nozzles of the printhead cartridge 12. The maintenance/priming element 36, when in contact with the printhead cartridge, maintains an airtight seal around the printhead nozzles.

The chamber 32 is also used as a purge ink receiver to receive non-printing ink ejected from the ink recording head during a purging maintenance procedure. Alternately, the maintenance station 30 may have a separate open receptacle for receiving non-printing ink ejected during a purging maintenance procedure which is not brought into sealable contact with the recording head. The purge ink receiver may also be located at a different position along the carriage motion, for example at the other side of the recording medium, rather than the side of the main maintenance station 30. Further, more that one purge ink receiver may be employed to reduce the amount of time used in ink recording head travel when a purge ink procedure is executed during an image recording task. U.S. Pat. No. 5,210,550 describes a maintenance station for ink jet printers in more detail, which is incorporated herein by reference.

The carriage 14 is moved back and forth in the scanning direction 24 by a belt 38 attached thereto. The belt 38 is driven by a first rotatable pulley 40 and a second rotatable pulley 42. The first rotatable pulley 40 is in turn, driven by a reversible motor 44 under control of the overall controller of the ink jet printer or the maintenance controller. In addition to the toothed-belt/pulley system for causing the carriage to move, it is also possible to control the motion of the carriage by using a cable/capstan, lead screw, or other mechanisms as known by those skilled in the art. To control the movement and position of the carriage 14 along the carriage rail 16, there is included an encoder having a linear strip 44 having photographically or mechanically reproduced fiducial marks 46. The pattern 46 is sensed by a sensor 48, such as a photodiode, attached to the printhead carriage 14. The linear strip 44 extends into an area outside the width of the recording medium 26 such that carriage control to a position in front of the maintenance station 30 can by accomplished when necessary. Other positioning devices such as rotary encoders, stepper motors or other known techniques are also possible.

The carriage 14, belt 38, rotatable pulleys 40 and 42, reversible motor 44, carriage rails 16, linear strip encoder 44, and sensor 48 constitute a positioning mechanism which can be used to position the ink recording head 12 and the purge ink receiver 32 opposite each other for purging ink drops into the purge ink receiver, chamber 32.

At the completion of a printing operation or at other appropriate times, the printhead cartridge 12 is moved to a position outside the printing zone to engage the maintenance station 30. When the printhead cartridge 12 is aligned therewith, the maintenance station 30 is moved towards the printhead cartridge 12 until the priming element 36 contacts the printhead cartridge 12. The printhead cartridge 12 usually ejects ink from all of the nozzles of the printhead to thereby purge the printhead nozzles and to force any ink from the nozzles which may have dried sufficiently to impede the proper ejection of ink therefrom. Typically, ink is ejected from every nozzle after a fixed printing interval into the maintenance station. These purging drops remove the viscous plug that forms at the ink jet nozzle-to-air interface due to the evaporation of the volatile components of the ink.

In one known printer, it has been found that for every 45 seconds of the ink jet nozzles being exposed to air, 25 drops of ink per nozzle are required to be ejected to protect from soft printing defects such as clogged nozzles which cause missing scan lines of image or partially clogged nozzles which cause misplaced scan lines and dots and improperly sized dots. While this ink purging only wastes a small amount of ink, it includes the movement of the printhead cartridge to the maintenance station located off the printed page, therefore resulting in a decrease in print speed, that is, an overall recording throughput reduction. Depending on the ink formulation and the ejector or nozzle design, the requirements for purging differ. In addition, for printers which offer a plurality of performance modes, the lower quality requirements of some modes versus others means that purging requirements for some modes may be different from the purging requirements of other modes. Such ink purging without taking into account whether or not a nozzle has ejected ink, and without adjusting purging criteria based on the selected performance mode, results in inefficient maintenance of the printhead nozzles.

In color ink recorders of the scanning carriage type illustrated in FIG. 1, the recording head will have inks of a plurality of colors and separate ink ejectors associated with each color ink. The ejectors may be in the same device with segmented ink supply pathways for the plurality of color inks or the recording head may be an assembly of recording head subunits in which different color inks supply the ink ejectors of a corresponding subunit. Or in some known ink jet systems, the recording head is an assembly of both types, for example a first subunit for black ink and black ink jets and a second subunit which is further segmented among cyan, magenta, and yellow inks and corresponding ejectors. Whatever the detailed organization of the recording head, the fact that the ink ejectors of different colors are carried by a common carriage 14 (in FIG. 1), means that performing an ink purging procedure on the ejectors of one color includes the interruption of printing of the ejectors of all of the colors of ink. Because of variations of the chemical properties of colorant materials and the possibility of differing print quality requirements for the different color separations of the image, it is likely that some of the color ink ejectors will require different ink purge conditions than those of other colors. Invoking ink purging without taking into account whether or not an ejector has ejected ink, and without adjusting purging criteria based on the properties of the different inks in a multi-color recorder results in inefficient operation of the color image recorder.

In view of these problems, the present invention includes an apparatus and a method for pre-setting the criterion for periodic ink purging based on a pre-selected one of a plurality of performance modes. In the case of a color ink recorder the criteria for periodic purging are preset based on at least one property of each of the plurality of color inks as well as a pre-selected performance mode if the color ink recorder provides a plurality of performance modes. The apparatus and method then determine for each period of the periodic ink purging cycle whether any of the ink ejectors within a printhead require ink purge maintenance. If any ejectors require purging, an ink purge procedure is executed. However, if none of the ejectors need ink purging, the ink purge procedure for that cycle is eliminated. Such intelligent maintenance adjusted to the pre-selected performance mode of the recorder, the image data, and the properties of each of the color inks in a multi-color recorder, not only increases the throughput in scanning type ink jet printers, but also reduces the amount of wasted ink. In fact, in the case of scanning type printhead carriages having partial width array printheads, the increase in throughput can be significant since typically all of the nozzles in a partial width array printhead eject ink sufficiently often to make many ink purge maintenance operations unnecessary.

Figure 2:
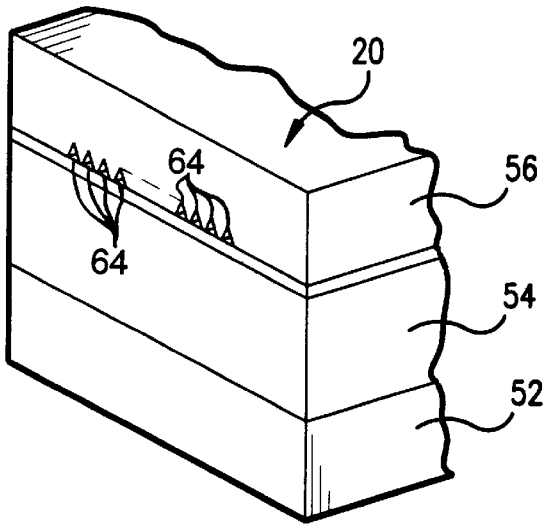
FIG. 2 illustrates a perspective view of the front face of a thermal ink jet device according to the present invention showing a plurality of ink ejecting orifices.

FIG. 2 illustrates a perspective view of the front face of a thermal ink jet device 20 showing a plurality of ink ejecting orifices or nozzles 64. The thermal ink jet device is constructed from several layers. A channel and ink reservoir layer 56 has fine, closely spaced grooves which serve as ink channels for individual ejectors as well as larger depressions and through-layer holes which serve as ink supply reservoirs and ink inlets. A heater layer 54 is fabricated by microelectronic methods and has a plurality of heating resistors, at least one heater resistor for each ink ejector channel, and resistor interconnection circuitry so that each heater resistor can be individually addressed and controlled to eject ink drops. Layer 52 is a heat sink provided to both support the other layers of the device and to store and conduct heat away from the heater resistor portion of the device enabling rapid repetition of drop ejection.

Figure 3:
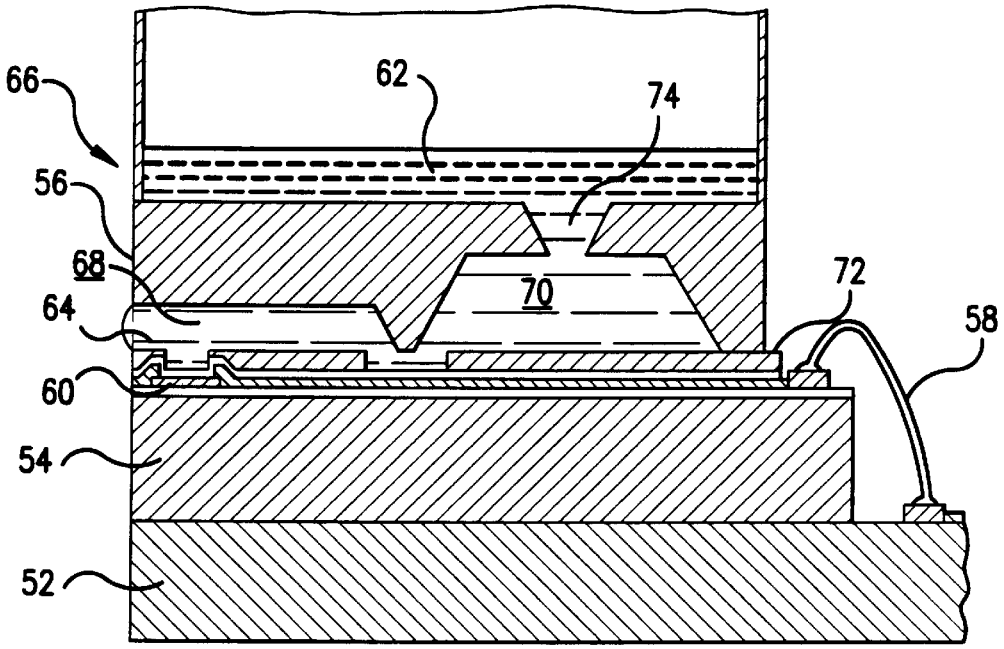
FIG. 3 is a cross-sectional view of one of a plurality of thermal ink jet ejectors according to the present invention such as are shown in FIG. 2.

FIG. 3 is a cross-sectional view of one of the plurality of thermal ink jet ejectors illustrated in front face perspective in FIG. 2. In this cross-sectional view some features of the channel and reservoir layer 56 and the heater resistor layer 54 can be seen. Also a portion of the wall 66 of the printhead cartridge 12 ink supply chamber can be seen attached to the upper surface of the channel and reservoir layer 56. Ink 62 enters through hole 74 into a local ink supply reservoir 70 and then can move into ink channel 68 ending at ejection orifice or nozzle 64. Heater resistor 60 is adjacent a portion of the ink near the end of ink channel 68. When heater resistor 60 is energized by a voltage pulse, the ink immediately adjacent the resistor in channel 68 is heated sufficiently for an ink component to vaporize creating a pressure pulse which ejects ink from nozzle 68.

There are many approaches known for applying a voltage pulse to a heater resistor 60. In the simplest thermal ink jet devices, an external lead such as wirebond 58 is provided for one terminal of each heater resistor and a common current return lead is provided for the other terminal. An external pulsing circuit provides the appropriate voltage pulses to the appropriate ejector resistors based on the image data via the individual ejector resistor leads. In a preferred embodiment, the thermal ink jet heater resistor layer 54 is an integrated circuit which includes, in addition to the heater resistors, a power MOS FET coupled to each resistor and addressing and drop ejection control circuitry for selecting and energizing the power MOS FET/resistor corresponding to the ink ejector from which ink ejection is required by the image data. Such a thermal ink jet device is described in U.S. Pat. Nos. 5,300,968 and 5,371,530 which are incorporated herein by reference.

Figure 4:
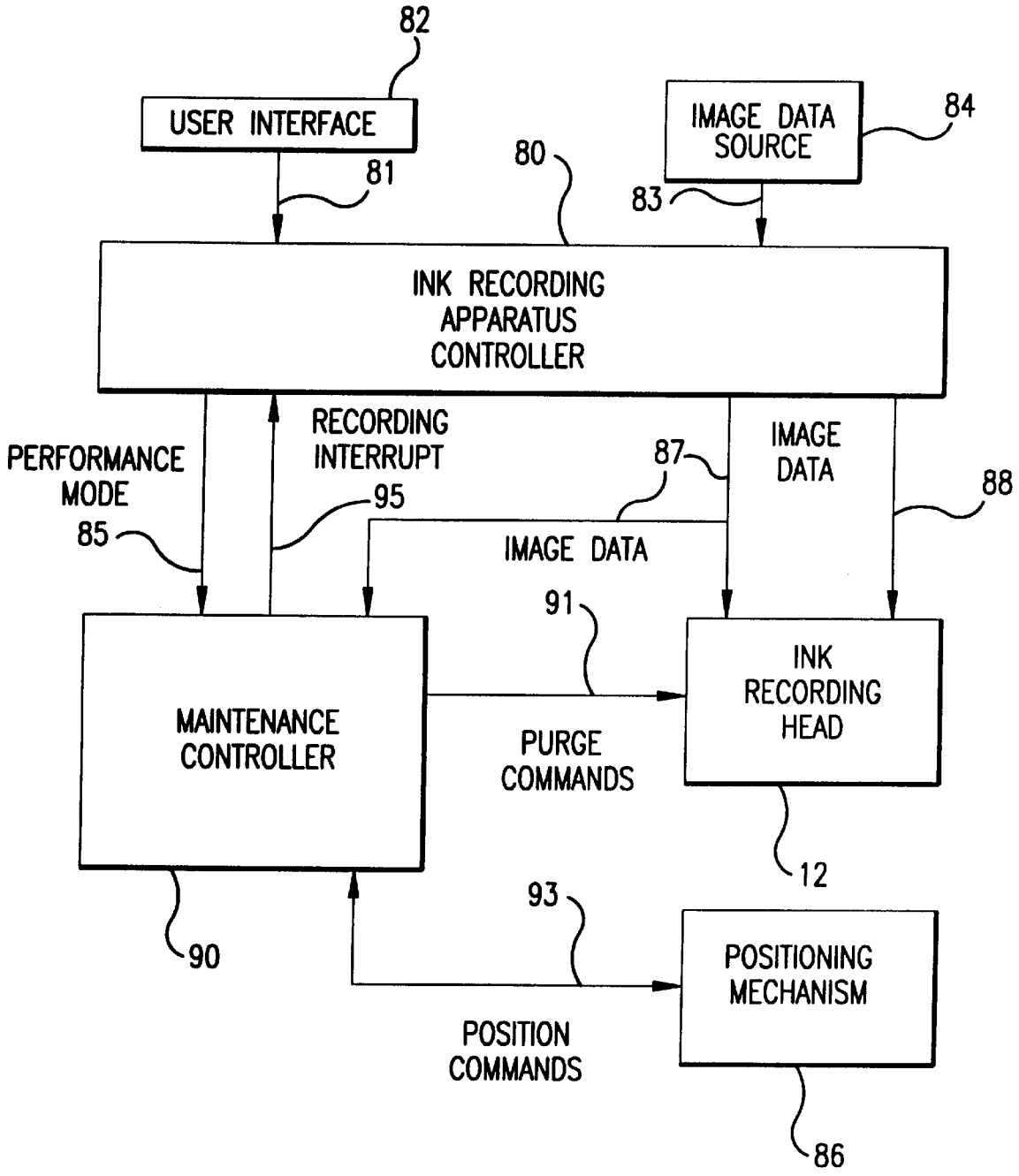
FIG. 4 is a block circuit diagram of an ink recording apparatus of the present invention.

FIG. 4 illustrates a block diagram of an electronic circuit for an ink recording apparatus incorporating the present invention. The ink jet printer 10 of FIG. 1 includes a controller or central processing unit (CPU) 80 which controls the operation of the printer including various circuitry not illustrated, such as paper feed driver circuits, carriage motor control circuits, and ink level detection circuitry. The apparatus controller 80 typically communicates over a bus with the various printer circuits and includes read only memory (ROM) and random access memory (RAM). The read only memory can include an operating program for the apparatus controller 80 for controlling the printer, and the random access memory can include accessible memory including print buffers for the manipulation of data and for the storage of printing information in the form of bitmaps received from an input device such as an image data source 84. The image data source 84 can be found in any number of devices generating print data including a personal computer or a scanner such as that found in a facsimile machine. In addition, the apparatus controller includes a electronic clock which is used to control various timing operations throughout the printer as is known by those skilled in the art.

The apparatus controller communicates with user interface 82 to receive instructions regarding the selected performance mode of each image recording task. For example, the ink recorder may support a plurality of performance modes which give the user choices among print quality, overall printing speed and receiver media type. The apparatus controller 80 receives the user's selections among these performance modes and features and operates the recording apparatus accordingly. The user interface 82 may be one of a number of common hardware or software subsystems, for example, an interactive hardware panel associated with the ink recording apparatus, a software interface accessed in the user's host system, or control parameter data attached to the image data file to be printed.

The apparatus controller 80 also controls the ejection of ink from the nozzles, each of which is associated with a respective heater resistor such as resistor 60 in FIG. 3. In a preferred embodiment, the thermal ink jet device 20 is an integrated circuit which includes, in addition to the heater resistors, a power MOS FET coupled to each resistor and addressing and drop ejection control circuitry for selecting and energizing the power MOS FET/resistor corresponding to the ink ejector from which ink ejection is required by the image data. Such a thermal ink jet device is described in U.S. Pat. Nos. 5,300,968 and 5,371,530 which are incorporated herein by reference. The apparatus controller 80 also controls the ejection of ink from the nozzles by communicating data and synchronizing signals to the thermal ink jet integrated circuit via image data bus 87 and control line 88.

The ink recording apparatus controller 80 also communicates with a maintenance controller 90 via control lines 85 and 95. The maintenance controller operates the printhead maintenance functions and procedures of the ink recorder. The maintenance procedures involve moving and positioning the recording head 20 opposite the maintenance station 30, supplying purge drop ejection pulse sequences to the recording head to effect non-printing ink purging, and operating a vacuum source (not shown) for priming the printhead and removing purged ink. In FIG. 4 the maintenance controller is shown schematically as a separate circuit but its functions may also be carried out by the apparatus controller 80 as a set of maintenance subroutines. The maintenance controller 90 receives information about the recording performance mode selected by the user from the apparatus controller 80 and also has access to the image data being sent to the recording head on image data bus 87. The maintenance controller 90 determines from the performance mode information and the image data, whether an ink purge procedure is needed to maintain the proper performance of the ink recording head. If ink purging is appropriate, the maintenance controller 90 outputs commands to the positioning mechanism to effect the movement of the ink recording head to the maintenance station 30 and purge ink commands to the recording head 12 so that purge ink drops can be ejected into the purge ink receiver, chamber 32.

Figure 5:
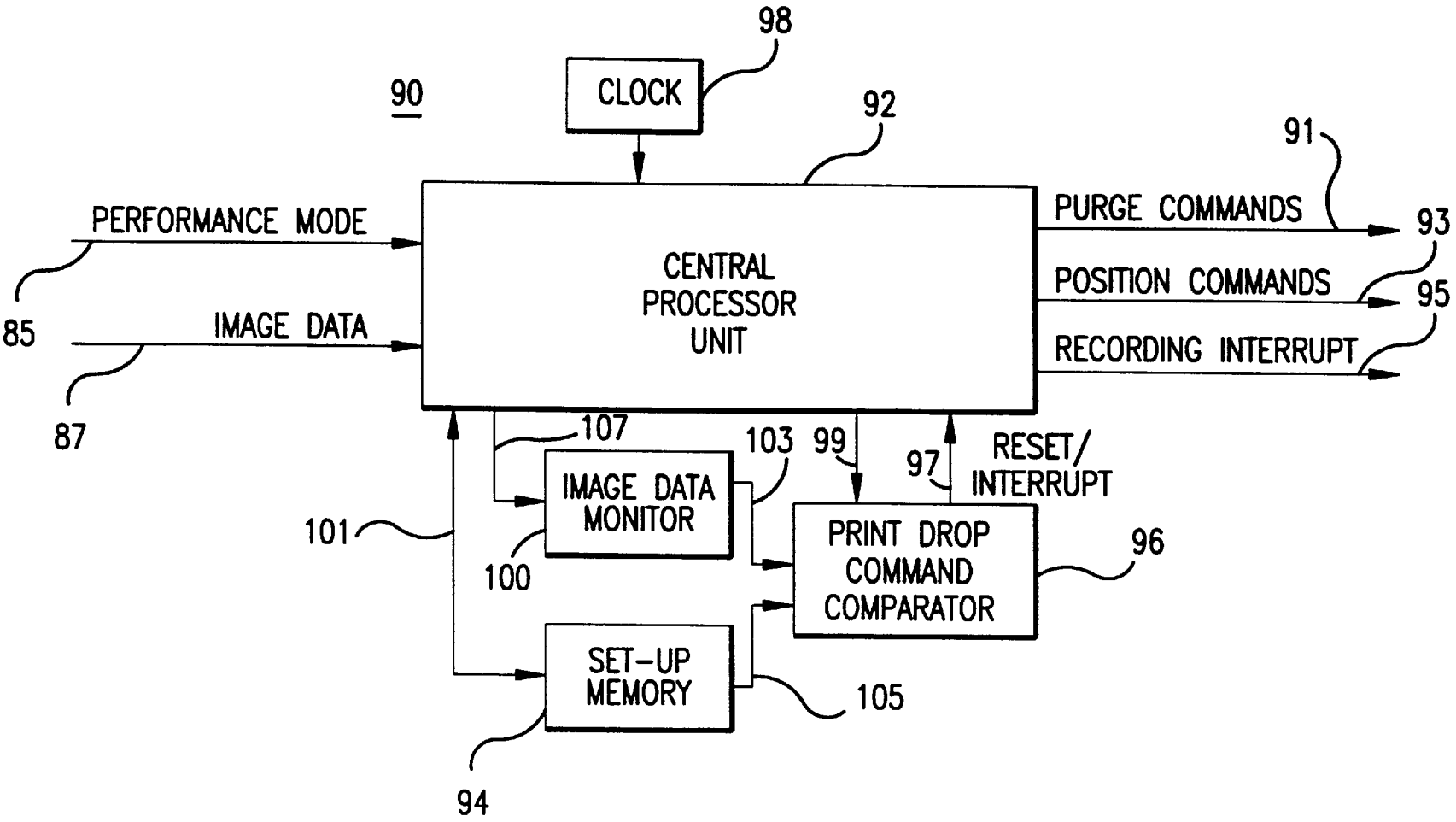
FIG. 5 is a block diagram of a maintenance controller circuit such as the one illustrated in FIG. 4.

The operation of the maintenance controller 90 can be further understood by reference to FIG. 5, a schematic diagram of one embodiment of the maintenance controller circuitry. The maintenance controller 90 includes a central processor unit 92, an electronic clock 98, an image data monitor 100, a set-up memory 94 and a print drop command comparator 96. The central processor unit (CPU) 92 can be any standard microprocessor and may include the clock 98 as an internal circuit. Similarly the set-up memory may be any standard random access memory or may be included with the CPU 92 as an internal circuit. The print drop command comparator 96 is a standard dual binary number comparator which compares binary number inputs presented on input ports A and B. The output of comparator 96 is a binary state 1 (one) or 0 (zero) depending upon whether the binary number at port A is less than the number at port B. The image data monitor 100 is a special circuit capable of monitoring the image data sent to each ink ejector of the ink recording head in the form of print drop commands. The image data monitor is illustrated further in FIG. 7 and will be discussed in detail below.

The CPU 92 of maintenance controller 90 communicates with the recording apparatus controller 80 shown in FIG. 4, receiving the same image data stream being sent to the ink recording head on bus 87. The maintenance controller CPU 92 also receives a signal on line 85 indicating the user selected one of the plurality of performance modes supported by the ink recording apparatus. For example, the recording apparatus may support three image quality modes: draft, normal, and pictorial quality. An image may be printed by the ink recorder in any of these modes. In the draft mode the image is delivered in the shortest time, for example, by deleting some image dots, whole image scan lines or by operating at high drop repetition frequencies which produce drops of less than optimum size or velocity. Print quality is sacrificed for speed in the draft mode. In the pictorial quality mode the image may be output with a high level of uniformity of spot placement and spot size on the receiver medium by, for example, blending spots on some image scan lines from different drop ejectors or blending adjacent image scan lines from different passes of the printhead by advancing the receiver medium less than a full printing swath height between passes of the scanning printhead. In the pictorial mode the image is delivered in the longest time but at the highest image quality. The normal mode represents a print quality/print speed choice which is intermediate to the draft and pictorial modes. The maintenance controller will vary the criteria for executing ink purging during image recording based on the performance mode selected, as described further below.

The image data monitor circuit 100, the set-up memory 94, and the print drop command comparator 96 together determine the necessity of executing a purge ink procedure during image printing. In the present invention, the necessity for ink purging is based on monitoring how many print drop ejections have been commanded for each ejector of the recording head during a pre-selected time interval, T, during image printing. The time elapsing during the printing of an image on a receiver medium is termed the current recording time. The pre-selected time interval, T, is termed the maximum current recording time.

Before the start of printing the maintenance controller loads a value for T, the maximum current recording time, and a value for N, the target number of print drop commands, into the set-up memory 94. The target number of print drop commands, N, represents the minimum number of drop ejections which should be ejected from an ejector during the maximum current recording time, T, to maintain a pre-determined level of ejector performance. Different performance modes of the ink recorder may use different values of T; different values of N; or, different values of both T and N.

In one embodiment of the invention, the value of T is the same for all performance modes but is possibly based on local environmental factors such as humidity and temperature. The value of N is changed for different performance modes. For example, in an ink recorder with three print quality modes, draft, normal and pictorial quality; there may be a different value of N for each quality mode. The N value for the draft mode will be smaller than the N value for the pictorial mode. Fewer drops are required to be ejected from each ejector during the maximum current recording time to maintain draft print quality than are required to maintain pictorial image quality. The N value for the normal mode will be an intermediate value.

In typical practice the values of N are determined by experiment and interpolation for each performance mode, ink, ejector design, and image recording application. In one known thermal ink jet printer it has been found that for a 45 second maximum current recording time, T=45 seconds, 25 drops of ink per nozzle are required to have been ejected to prevent soft print quality failures in the normal printing mode. For this printer the N values set for draft, normal, and pictorial quality modes therefore might be 15, 25 and 40, respectively, for T=45 seconds.

In alternative embodiments of the invention the maintenance controller may set the same N value for all performance modes but set a different T value for each mode. Or, further embodiments of the invention may set different values of both T and N for each performance mode.

At the start of printing the maintenance controller 90 begins timing the current recording time by use of electronic clock 98. The maintenance controller CPU 92 determines when the current recording time exceeds T, the pre-selected maximum current recording time loaded in the set-up memory 94, via a time comparison subroutine. When CPU 92 determines that time T has been exceeded, the maintenance controller 90 determines the necessity of interrupting printing for an ink purge procedure. The image data monitor 100 counts the number of print drop commands sent to each ejector of the ink recording head during the current recording time interval. The CPU 92 causes the target number of print drop commands, N, which was loaded into the set-up memory 94 to be presented to port B of the print drop comparator 96 via line 105. The maintenance CPU 92 then causes the image data monitor 100 to present, one-by-one, the print drop command counts for each ejector to port A of the print drop command comparator 96. The image data monitor 100 is illustrated further in FIG. 7 and will be discussed in detail below.

The output of the print drop comparator 96 on line 97 will be a logic level 0 for each ejector having a print drop command count equal to or greater than the target number of print drop commands, N. If, however, an ejector has a print drop command count less than N, the output 97 of comparator 96 will be a logic level 1. The maintenance CPU 92 monitors the output 97 of comparator 96 as the print drop command counts of each ejector are presented one-by-one by the image data monitor 100. If a logic level 1 is detected, the necessity for a purge ink procedure is established. If all of the print drop command counts for all of the ejectors have been compared to N by comparator 96 and no logic level 1's are detected, then a purge ink procedure is not necessary and the maintenance controller 90 instead generates a maintenance timing reset signal, resetting the current recording time to zero and resetting the image data monitor 100 to begin a new count of the print drop commands for each ejector of the ink recording head.

Figure 6:
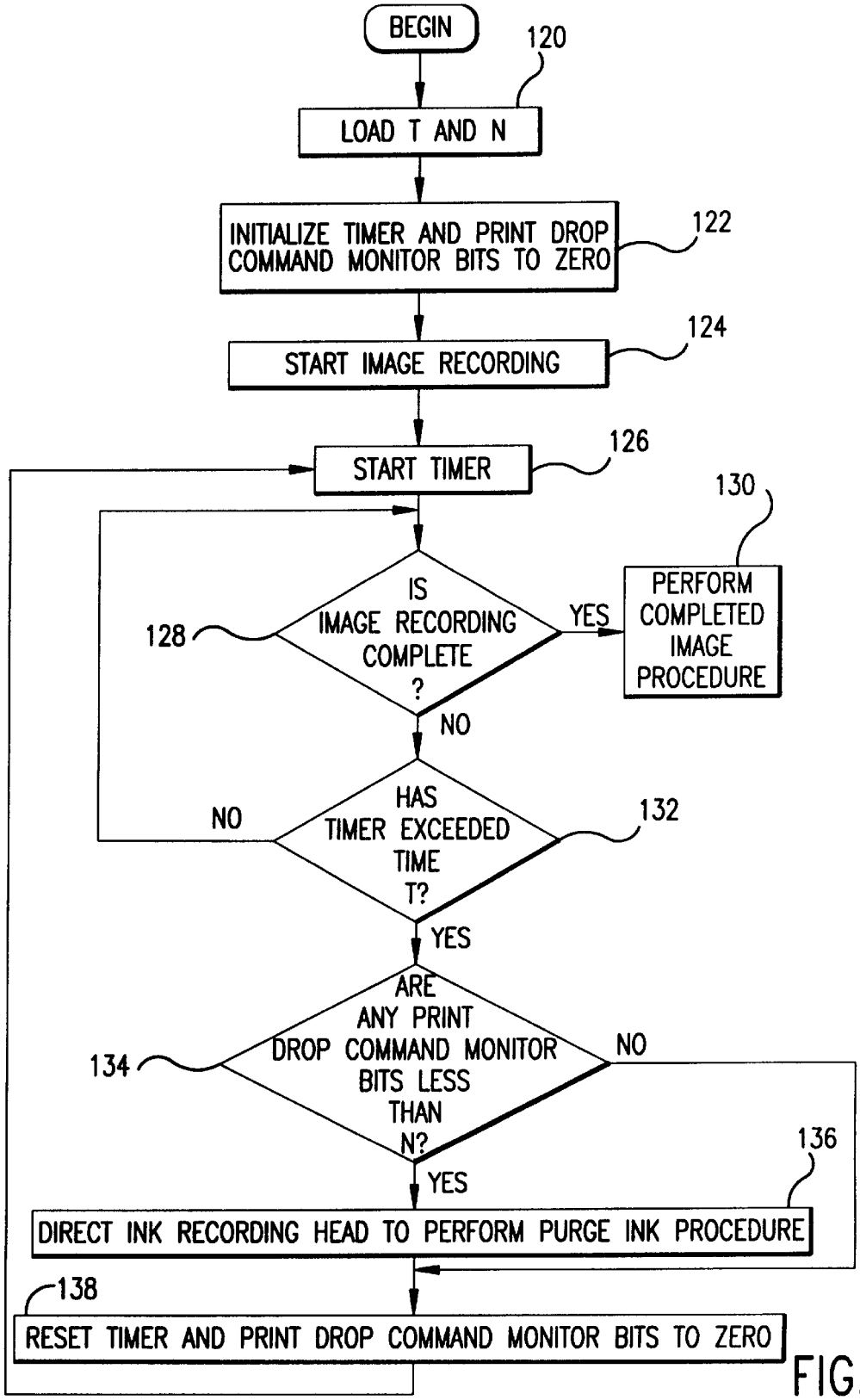
FIG. 6 is a flow diagram illustrating a maintenance operation for ejecting purge ink drops or not ejecting purge ink drops according to the present invention.

The sequence of events described above can be further understood from the flow chart of FIG. 6. The values of T and N are loaded in memory at step 120. The current recording time timer and print drop command counters in the image data monitor 100 are initialized to zero in step 122. Image recording (printing) is started at step 124. The current recording time timer is started in step 126. In step 128, the maintenance controller 90 then queries the recording apparatus controller 80 for an image recording completion status indicator. If image recording is complete, then the maintenance controller 90 directs the maintenance procedure appropriate for a completed image, designated as step 130. For example, the recording head may be returned to the maintenance station 30 and capped. If image recording is not complete, the program moves to step 132.

In step 132, the maintenance controller 90 compares the current recording time to time T. If the current recording time is less than T, then the controller returns the program to step 128 to again check for an image recording status indicator. However, when, in step 132, the current recording time is found to exceed time T, the maintenance controller 90 causes, in step 134, a check on the number of print drop commands received by each ejector during the time T.

In step 134, the maintenance controller CPU 92 causes the image data monitor 100 to present the print drop command count, one-by-one, for each ejector of the ink recording head to the print drop comparator 96 to be compared to the target number of print drop commands, N. If any ejectors have received less than N print drop commands, the maintenance controller directs a purge ink procedure, step 136. If, however, all ejectors have received N or more print drop commands, the maintenance controller skips step 136 and moves directly to step 138, generating a maintenance timing reset signal, resetting the current recording time timer and the print drop command monitor ejector counters 104 bits to zero. Step 138 is also reached following completion of the ink purge procedure, step 136. After step 138 is complete the program returns to step 126, restarting the current recording time timer.

The purge ink procedure, step 136, is avoided if all ejectors have received N or more print drop commands, thereby reducing non-recording time and ink waste.

The purge ink procedure may involve several elements but at least includes the ejection of a sufficient number of drops from each ejector to restore the ink characteristics present at each ejector to nominal values. The purge ink procedure usually includes sending the target number of print drop commands, N, to each of the ejectors of the recording head and ejecting the resulting ink into the purge ink receiver. Since in the present invention the value of N may be different for different performance modes of the ink recorder, the purge ink procedure may be different for different performance modes. The purge ink procedure may also call for a same set number print drop commands to each of the ejectors for all performance modes.

The purge ink procedure may involve special sequences and patterns of purge drop ejecting among the plurality of ejectors and may also involve pulsing ejectors with pulse energies below that necessary for drop ejection for the purpose of pre-heating or pre-moving the ink in the ejector nozzle region prior to ink purging pulses. The exact details of the ink purging procedure are not crucial to the present invention which is primarily concerned with optimizing the balance between invoking a purge ink procedure often enough to maintain print quality consistent with a preselected ink recorder performance mode but not so often as to unnecessarily lose overall printing speed and excessively waste ink.

Figure 7:
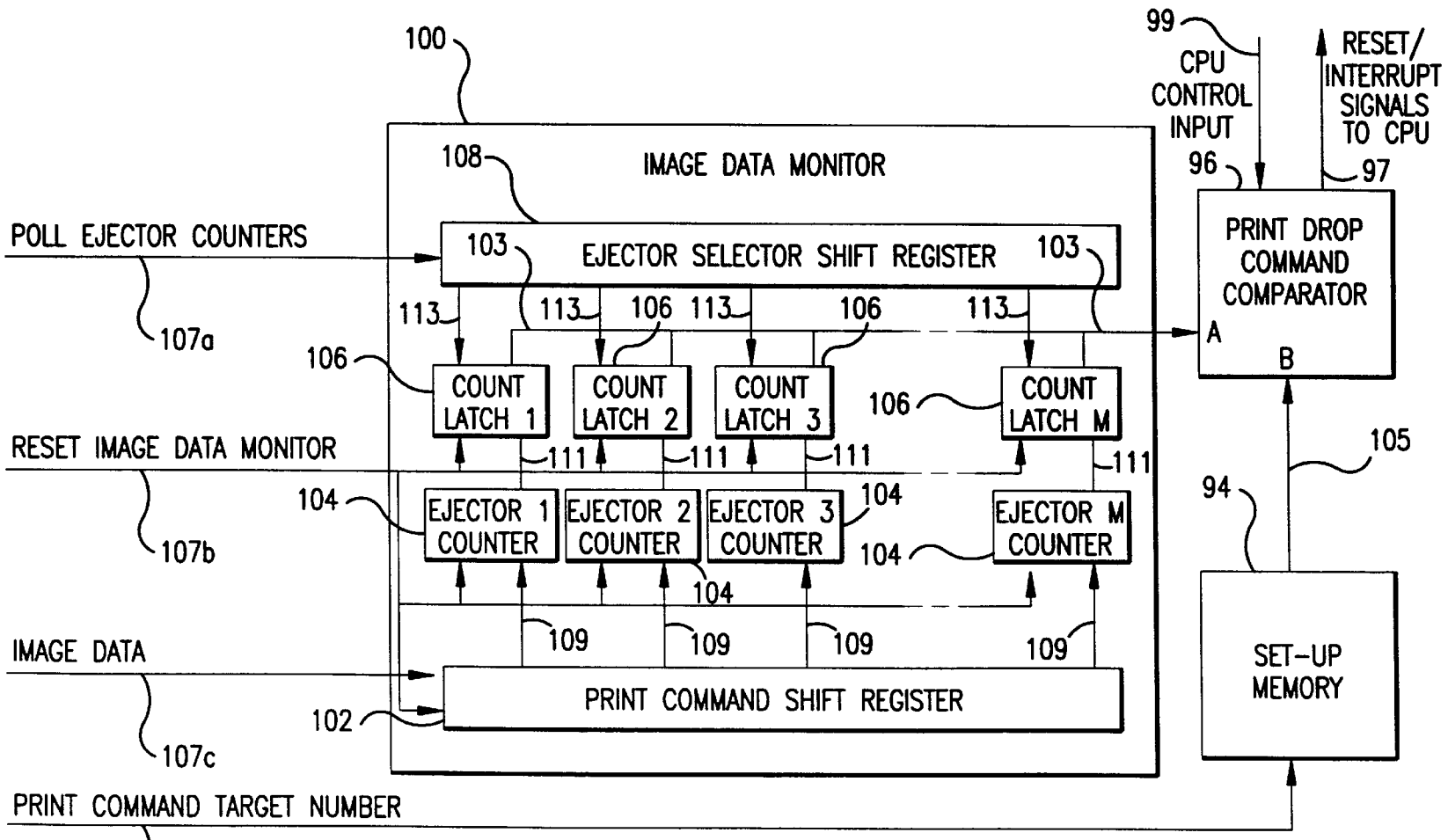
FIG. 7 is a block circuit diagram of an image data monitor such as the one illustrated in FIG. 5.

FIG. 7 illustrates one embodiment of circuitry for an image data monitor 100. For clarity the print drop command comparator 96 and set-up memory 94 of the maintenance controller 90 are also shown in FIG. 7. The image data monitor comprises a print command shift register 102, a set of M ejector counters 104, one counter for each of the M ejectors in an ink recording head, a corresponding set of M count latches 106, and an ejector selector shift register 108. The image data presented to the ink recording head on image data bus 87 is presented to the image data monitor 100 by the maintenance controller CPU 92 on line 107*c* where it is shifted into the print command shift register 102. Shift register 102 is a standard serial-to-parallel data shift register having M parallel outputs. The image data for the M ejectors of the ink recording head is input as M serial bits which then appear as input bits on lines 109 for the M ejector counters 104.

The counters 104 are standard binary counters. These counters should be able to accumulate a count at least as large as the largest value of N, the target number of print drop commands, contemplated for the ink recording apparatus. For example, if one of the ink types to be used by an ink recorder requires 63 drops to have been ejected during the longest planned maximum current recording time, T, for the highest quality performance mode of the ink recorder, in order to maintain acceptable print quality, then the binary counters 104 should be at least 6 bit counters. The ejector counters 104 are allowed to count up to and hold their maximum binary number. As long as this maximum counting value capacity is higher than the highest value of N set by the maintenance controller, a proper determination of the necessity for ink purging can be made. The image data monitor need not fully count the print drop commands received by the ejectors but only need count enough to determine if the target value N has been equaled or exceeded by each ejector.

The count latches 106 and the ejector shift register 108 are employed together to poll the ejector counters 104 one-by-one. Shift register 108 is a serial-to-parallel shift register with M parallel outputs. Shift register 108 is used in well known token bit fashion to select the count latches 106 one-by-one. A single bit of data, commonly termed the token, is shifted down shift register 108 by a clocking signal from CPU 92 over signal line 107*a*. The output bit of the shift register 108 shifts one position for each clocking cycle causing each count latch 106 to latch the corresponding ejector counter 104 output on lines 111 when the token bit is at the latching input 113 of each count latch 106. The count latches 106 are caused to reset to zero when the token bit shifts away to the next count latch. Each count latch 106 presents the count value latched from the corresponding ejector counter 104 to the port A of the print drop comparator 96 via the data bus 103. In this fashion the image data monitor 100 is caused to count the print drop commands sent to each ejector by the image data, to latch the count of print drop commands accumulated by each ejector (up to the maximum counting capacity of the ejector counters 104), and to present this count one-by-one for each ejector to the print drop command comparator 96 to be compared the target number of print drop commands, N. The image data monitor is reset for each new current recording time counting period via reset signal line 107*b*.

While discrete circuitry has been illustrated for the various elements of the image data monitor 100 shown in FIG. 7 and the elements of the maintenance controller 90 in FIG. 5, all of these circuit elements could be replaced by software or stored firmware subroutines executed by maintenance controller CPU 92 or by the ink recording apparatus controller 80. By appropriate use of memory locations associated with each ejector and well known counting and number comparison subroutines, the determination of whether every ejector has received at least N print drop commands during the time T could be readily made by CPU 92 or controller 80. Alternately, the various circuit elements of the image data monitor 100 shown in FIG. 7 and the elements of the maintenance controller 90 in FIG. 5 could be configured in an application specific integrated circuit (ASIC) or in some combination of ASIC, discrete elements and software or firmware executed by maintenance controller CPU 92 or ink recording apparatus controller 80.

In another embodiment of the present invention an ink recording apparatus is used to record color images on a recording medium. The ink recording apparatus includes a recording head having a plurality of color inks and a plurality of ink ejectors for each color ink. For example, the plurality of color inks may include black, cyan, magenta, and yellow inks. Each of these inks may have different requirements for the frequency of ink purging. And, also, the overall effect on the quality of the color image may be different for different amounts of misplaced and incorrectly sized ink spots of the different individual ink colors. Therefore, in the case of a color ink recorder the criteria for periodic purging are preset based on at least one property of each of the plurality of color inks as well as a pre-selected performance mode if the color ink recorder provides a plurality of performance modes.

The maintenance controller 90 in FIGS. 4 and 5, for the case that the ink recording apparatus 10 is a color image recorder, sets a value of $N_i$ for each color ink and monitors the color image data color-by-color. This can be done by replicating the image data monitor 100 and print drop command comparator 96 in FIG. 5 for each color ink. Alternatively it is straightforward to perform the image data monitoring and comparisons to target values, $N_i$, for the numbers of print commands received by the ejectors of each ink color via stored firmware and software subroutines executed by a maintenance controller CPU 92 or by the ink recording apparatus controller 80. A purge ink procedure will be executed if any of the ejectors of any of the color inks fails to reach the target number of print drop commands corresponding to the corresponding color ink.

The present invention provides for the adjustment of the target number print commands for each color ink individually and further for each performance mode of the color ink recorder when there is a plurality of performance modes. Inks which are less sensitive to evaporation or whose effect on print quality perception are less than others can have lower values of N, thereby triggering fewer purge ink procedures.

Figure 8:
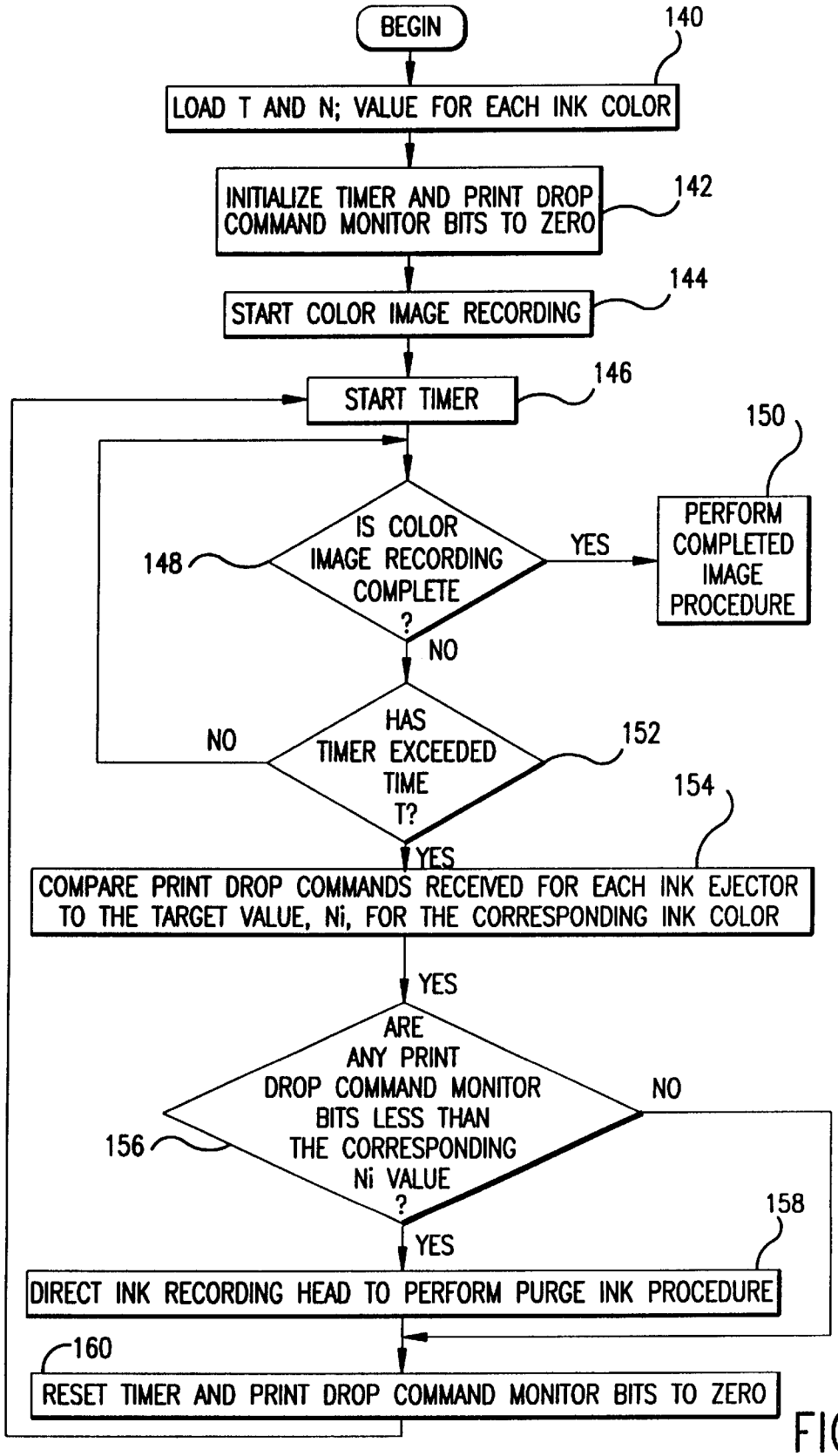
FIG. 8 is a flow diagram illustrating a maintenance operation for ejecting purge ink drops or not ejecting purge ink drops for the case of a color image recording apparatus, according to the present invention.

The sequence of events described above for a color image ink recording apparatus can be further understood from the flow chart of FIG. 8. The values of T and $N_i$ are loaded at step 140. The current recording time timer and print drop command counters in the image data monitor 100 are initialized to zero in step 142. Color image recording (printing) is started at step 144. The current recording timer is started in step 146. In step 148, the maintenance controller 90 then queries the recording apparatus controller 80 for an image recording completion status indicator. If image recording is complete, then the maintenance controller 90 performs the maintenance procedure appropriate for a completed image, designated as step 150. For example, the recording head may be returned to the maintenance station 30 and capped. If image recording is not complete, the program moves to step 152.

In step 152, the maintenance controller 90 compares the current recording time to time T. If the current recording time is less than T, then the controller returns the program to step 148 to again check for an image recording status indicator. However, when, in step 148, the current recording time is found to exceed time T, the program moves to step 154 and a check on the number of print drop commands received by each ejector during the time T is performed In step 154, the maintenance controller CPU 92 causes the image data monitor 100 to present the print drop command count, one-by-one, for each ejector of each color ink of the ink recording head, to the print drop comparator 96 to be compared to the target number of print drop commands, $N_i$, corresponding to the color ink of each ejector. At step 156, if any ejectors have received less than the corresponding $N_i$ print drop commands, the maintenance controller directs a purge ink procedure, step 158. If, however, all ejectors have received the corresponding $N_i$ or more print drop commands, the maintenance controller skips step 158 and moves directly to step 160, generating a maintenance timing reset signal, resetting the current recording time timer and the print drop command monitor ejector counters 104 bits to zero. Step 160 is also reached following completion of the ink purge procedure, step 158. After step 160 is complete the program returns to step 146, restarting the current recording time timer.

The purge ink procedure, step 158, is avoided if all color ink ejectors have received the corresponding $N_i$ or more print drop commands, thereby reducing non-recording time and ink waste.

In recapitulation, there has been described an apparatus and method for maintaining the proper operation of an ink recorder having an ink recording head which prints an image on a recording medium by selectively depositing ink drops from a plurality of ink ejectors in response to image data. The ink recorder supports a plurality of performance modes and may be a color image recorder having a plurality of color inks and a plurality of ink ejectors for each color ink. A time period during printing is determined and the number of print drop commands received by each of the plurality of ink ejectors is counted during the time period. A target value for the number of print drop commands received by each ejector is set based on a pre-determined one of the plurality of performance modes, the image data, and a characteristic of each color ink in the case of a color ink recorder. If, during the time period determined, all of the ejectors receive the appropriate target number of print commands, then a purge ink procedure is not executed and printing is not interrupted. The print quality, overall printing speed, and ink waste are optimized by utilizing all of the factors cited in setting the target values for the number of print commands to be received by each ink ejector in order to avoid unneeded purge ink procedures.

While this invention has been described in conjunction with a specific embodiment thereof, it is evident that many alternatives, modifications, and variations will be apparent to those skilled in the art. The present invention is therefore not limited to the embodiments described herein but is equally applicable to other apparatus and methods which record images by use of a plurality of ink ejectors and support a plurality of performance modes for which the consequences of ink evaporation at the ink ejectors may differ. For instance, an ink recorder may be used for addressing or labeling objects or media which pass by a stationary ink recording head. In such a recorder the ink recording head may need to be moved to a maintenance station position for performing necessary procedures such as capping and purging ink from little used ejectors to maintain proper operation of every ejector. The same considerations for optimizing system throughput described above in the context of a carriage style ink jet printer apply to this case of a stationary recording head since the head must be repositioned for periodic maintenance operations.

In another instance the purge ink receiver may be moved into a position opposite the recording head or both may be moved instead of moving the recording head alone as described in the above embodiments. The same considerations of the loss of printing throughput due to the interruption of the printing process and time consuming mechanical actuation of the positioning mechanism apply in this alternate embodiment of an ink recorder. Application of the maintenance controller and methods described herein are equally effective in optimizing the performance of such a system as they are for the previously described ink recorder embodiments.

Accordingly, the present invention is intended to embrace all such alternatives, modifications and variations that fall within the spirit and broad scope of the appended claims.

What is claimed is:

1. An ink recording apparatus for recording an image on a receiving medium in a plurality of performance modes, comprising:

an ink recording head having a plurality of ink ejectors which eject ink drops onto a receiving medium in response to print drop commands based on image data;

a purge ink receiver periodically cooperated with the ink recording head; and a maintenance controller, in communication with the ink recording head, for directing the ink recording head to perform a purge ink procedure, including an ejection of purge ink drops to the purge ink receiver from the plurality of ink ejectors, as a function of the image data and a pre-selected performance mode of a plurality of performance modes, wherein the maintenance controller comprises:

a maintenance timing reset signal generator that generates a maintenance timing reset signal, a timer that determines a current image recording time, which defines a time elapsed during image recording since an occurrence of one of a last purge ink procedure and said maintenance timing reset signal, an image data monitor to monitor a number of print drop commands received by each of the plurality of ink ejectors during the current image recording time, a set-up memory that stores a value of at least one of the maximum current recording time T, and a target number of print drop commands N; based on a pre-selected performance mode, and control means for after the current image recording time exceeds said maximum current recording time T, generating a maintenance timing reset signal if all of the ink ejectors have received N print drop commands, and interrupting image recording and directing a purge ink procedure if at least one of the plurality of ink ejectors has failed to receive said target number N of print drop commands.

2. The ink recording apparatus of claim 1, wherein the plurality of performance modes comprises a plurality of image quality modes characterized by an order of image quality from lowest image quality to highest image quality and a corresponding plurality of maximum current recording times having a corresponding order from longest maximum current recording time to shortest maximum current recording time.

3. The ink recording apparatus of claim 1, wherein the plurality of performance modes comprises a plurality of recording speed modes characterized by an order of recording speed from lowest speed to highest speed and a corresponding plurality of maximum current recording times having a corresponding order from shortest maximum current recording time to longest maximum current recording time.

4. The ink recording apparatus of claim 1, wherein the plurality of performance modes comprises a plurality of image quality modes characterized by an order of image quality from lowest image quality to highest image quality and a corresponding plurality of target numbers of print drop commands having a corresponding order from smallest target number of print drop commands to largest target number of print drop commands.

5. The ink recording apparatus of claim 1, wherein the plurality of performance modes comprises a plurality of recording speed modes characterized by an order of recording speed from lowest speed to highest speed and a corresponding plurality of target numbers of print drop commands having a corresponding order from largest target number of print drop commands to smallest target number of print drop commands.

6. The ink recording apparatus of claim 1, further comprising:

an ink recording apparatus controller; and, wherein the maintenance controller comprises at least one of firmware and software executed by the ink recording apparatus controller.

7. An ink recording apparatus for recording a color image on a receiving medium, comprising:

an ink recording head having a plurality of color inks and a plurality of ink ejectors for each color ink that eject ink drops on a receiving medium in response to color image data;

a purge ink receiver periodically cooperated with the ink recording head; and a maintenance controller, in communication with the ink recording head, for directing the ink recording head to perform a purge ink procedure, including an ejection of purge ink drops to the purge ink receiver from the plurality of ink ejectors, as a function of the color image data and at least one property of each of the plurality of color inks, wherein the maintenance controller comprises:

a maintenance timing reset signal generator that generates a maintenance timing reset signal, a timer that determines a current image recording time, which defines a time elapsed during image recording since an occurrence of one of a last purge ink procedure and said maintenance timing reset signal, a color image data monitor to monitor a number of print drop commands received by each of the plurality of ink ejectors during the current image recording time, a set-up memory that stores the value of the maximum current image recording time T, and a plurality of target numbers of print drop commands, one target number $N_i$ of print drop commands corresponding to each of the plurality of color inks, and control means that, after the current image recording time exceeds said maximum current recording time T, compares the number of print drop commands received by each color ink ejector to the corresponding one of the plurality of target numbers of print drop commands N, for a corresponding color ink, and generating a maintenance timing reset signal if all of the ink ejectors have received the corresponding target number of eject print drop commands, and interrupting image recording and directs a purge ink procedure if at least one of the plurality of color ink ejectors has failed to receive the corresponding target number of print drop commands.

8. The ink recording apparatus of claim 7, further having a plurality of performance modes, wherein the maintenance controller directs the ink recording head to perform a purge ink procedure as a function of the color image data, at least one property of each of the plurality of color inks, and a pre-selected one of the plurality of performance modes.

9. The ink recording apparatus of claim 8, further having a plurality of performance modes, wherein the set-up memory stores the value of the maximum current recording time, T, as a function of a pre-selected one of a plurality of performance modes.

10. The ink recording apparatus of claim 9, wherein the plurality of performance modes comprises a plurality of image quality modes characterized by an order of image quality from lowest image quality to highest image quality and a corresponding plurality of maximum current recording times having a corresponding order from longest maximum current recording time to shortest maximum current recording time.

11. The ink recording apparatus of claim 9, wherein the plurality of performance modes comprises a plurality of recording speed modes characterized by an order of recording speed from lowest recording speed to highest recording speed and a corresponding plurality of maximum current recording times having a corresponding order from shortest maximum current recording time to longest maximum current recording time.

12. The ink recording apparatus of claim 7, further having a plurality of performance modes, wherein the set-up memory stores the plurality of target numbers of print drop commands ($N_i$), one corresponding to each of the plurality of color inks, as a function of a pre-selected one of a plurality of performance modes.

13. The ink recording apparatus of claim 7, further comprising:

an ink recording apparatus controller; and, wherein the maintenance controller comprises at least one of firmware and software executed by the ink recording apparatus controller.

14. A method of maintaining proper operation of an ink recording apparatus having an ink recording head with a plurality of ink ejectors for ejecting ink drops on a recording medium in response to print drop commands based on image data and a plurality of performance modes, the method comprising the steps of:

determining whether the ejection of purge ink drops from the plurality of ink ejectors is appropriate;

interrupting image recording when ejection of purge ink drops is appropriate; and purging ink from the nozzles as a function of the image data and one of a plurality of pre-selected performance modes to maintain a proper operation of the ink recording head, wherein said determining step further comprises:

measuring a current image recording time, which defines a time elapsed during image recording since an occurrence of one of a last purge ink procedure and a maintenance timing reset signal, monitoring a number of print drop commands received by each of the plurality of ink ejectors, storing a value of a maximum current recording time T, and a target number of print drop commands N, based on a pre-selected performance mode, detecting when the current image recording time exceeds said maximum current recording time T, comparing the number of print drop commands received by each of the plurality of ink ejectors to N at said maximum current recording time T, and generating a maintenance timing reset signal, wherein said determining step determines that a purge drop procedure is appropriate if at least one of the plurality of drop ejectors has failed to receive N print drop commands at said maximum current recording time T.

15. The method of claim 14, wherein the plurality of performance modes comprises a plurality of image quality modes characterized by an order of image quality from lowest image quality to highest image quality and a corresponding plurality of maximum current recording times having a corresponding order from longest maximum current recording time to shortest maximum current recording time.

16. The method of claim 14, wherein the plurality of performance modes comprises a plurality of image quality modes characterized by an order of image quality from lowest image quality to highest image quality and a corresponding plurality of target numbers of print drop commands having a corresponding order from smallest target number of print drop commands to largest target number of print drop commands.

* * * * *